United States Patent [19]

Brown

[11] Patent Number: 4,735,409

[45] Date of Patent: Apr. 5, 1988

[54] SHEET FEEDERS

[75] Inventor: Ian G. Brown, Hitchin, United Kingdom

[73] Assignee: Xerox Corporation, Stamford, Conn.

[21] Appl. No.: 10,604

[22] Filed: Feb. 4, 1987

[30] Foreign Application Priority Data

Feb. 10, 1986 [GB] United Kingdom ..... 8603246

[51] Int. Cl.[4] ..... B75H 29/20

[52] U.S. Cl. ..... 271/186; 271/902

[58] Field of Search ..... 271/186, 291, 225, 902

[56] References Cited

U.S. PATENT DOCUMENTS

| | | | |
|---|---|---|---|
| 4,049,255 | 9/1977 | Stange | 271/902 X |
| 4,078,789 | 3/1978 | Kittredge et al. | 271/65 |
| 4,359,217 | 11/1982 | Roller et al. | 271/186 |
| 4,385,825 | 5/1983 | Kaneko | 355/3 SH |
| 4,487,506 | 12/1976 | Repp et al. | 355/14 SH |
| 4,506,882 | 3/1985 | Ito | 271/186 X |

FOREIGN PATENT DOCUMENTS

| | | | |
|---|---|---|---|
| 22874 | 2/1984 | Japan | 271/186 |

OTHER PUBLICATIONS

IBM Tech. Disc. Bulletin, vol. 8, #3, Aug. '75, pp. 628–629, entitled "Sheet Inverter", by P. S. Bach.

*Primary Examiner*—Richard A. Schacher

*Attorney, Agent, or Firm*—William A. Henry, II

[57] ABSTRACT

A sheet feeder for dealing with simplex or duplex copy sheets from a copier or like reprographic machine uses four rollers forming three sheet-feeding nips. All sheets enter the central nip: on leaving it they are selectively diverted into one or other of two sheet pockets, from which they bounce or are otherwise fed back into an aligned other nip. Sheets passing through one outer nip may be fed to an output tray, while those passing through the other nip may go back into the machine for further processing.

5 Claims, 1 Drawing Sheet

SHEET FEEDERS

This invention relates to sheet feeders, by which is meant a device which grips a sheet of any laminar material and feeds it along one or other of its orthogonal axes.

In the field of reprographic machines, it is often necessary to feed along one of two alternative paths a copy sheet leaving the processor of the machine, particularly when the machine can selectively produce simplex (one-sided) and duplex (two-sided) sheets. Simplex sheets may be fed directly to an output tray, whereas the duplex sheets may pass to a sheet feeder which automatically reverses the direction of movement of a simplex sheet and feeds it back into the processor, but inverted, so that the appropriate data can be applied to the second side of the sheet. One known sheet-feeder (U.S. Pat. No. 4,359,217) for effecting this includes three rollers in frictional or geared contact with each other, to provide two spaced-apart nips, one being an input nip to an associated downstream sheet pocket, and the other being an output nip for extracting each sheet from the pocket.

Other known copy sheet inverters include U.S. Pat. Nos. 4,487,506; 4,078,789; and 4,385,825. All of the patents show tri-roll inverters that are used to feed copy sheets into and out of a chute for inversion purposes. A sheet turnaround device is disclosed in IBM Technical Disclosure Bulletin, Vol. 18, No. 3, August 1975, Page 628, that changes the leading edge of a sheet while subjecting the sheet to harmonic motion reversing, all the while continuously engaging the surface of the sheet with a drive means.

The present invention aims at providing a sheet-feeder designed to have both simplex and duplex sheets fed to it along a common input path, and which sorts out the sheets into two pockets, from which the sheets are extracted and fed along one of two different output paths.

Accordingly, the present invention provides a sheet-feeder which is as claimed in the appendant claims.

Figure 1:
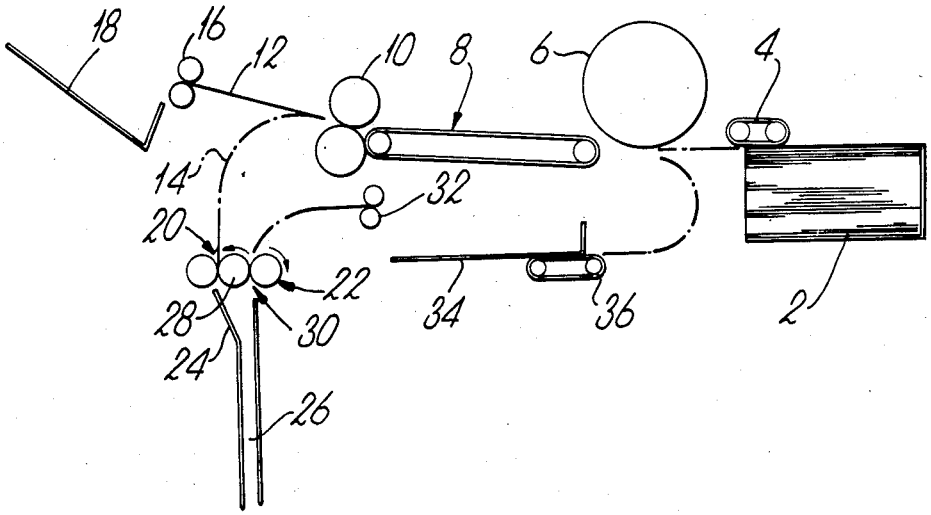
Figure 2:
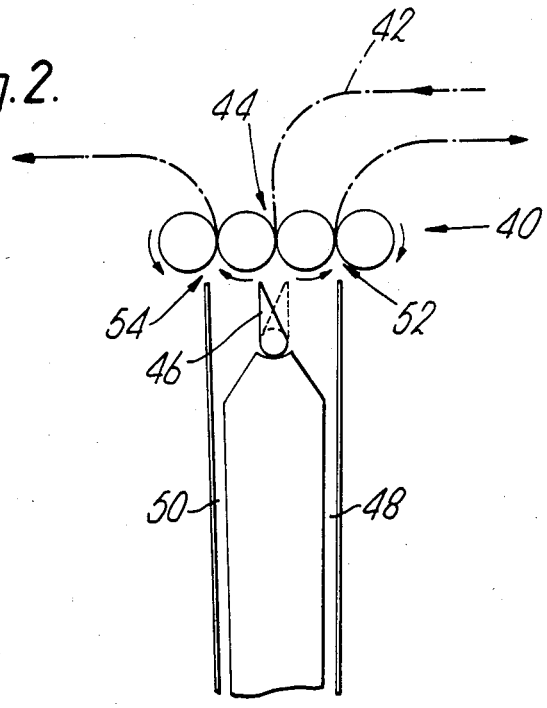

The present invention will now be described by way of example with reference to the accompanying drawings, in which:

FIG. 1 is a diagrammatic view of a reprographic machine incorporating a three-roll sheet-feeder, and FIG. 2 is a diagrammatic side view of the four-roll sheet-feeder of the present invention.

The known apparatus shown in FIG. 1 consists basically of means for holding a stack 2 of copy sheets adjacent to a feeder 4 for extracting a sheet from the top of the stack each time a copy is required. Each sheet leaving feeder 4 passes in non-sliding contact with a photoreceptor 6 (shown herein the form of a drum, although it could equally be a belt), from which a particulate material (toner) designed to present a visual contrast with the material of the sheet is transferred from the surface of the photoreceptor to the upper face of the respective sheet. After the sheet with the toner image held on it by electrostatic attraction has been detached from the photoreceptor 6, it is conveyed by a conveyer 8 to a fuser 10, which fuses the toner into a permanent bond with the material forming the sheet, by the application of heat and/or pressure.

On leaving the fuser, the sheet contacts a diverter (not shown) which deflects the sheet so that it moves along one of two paths 12 and 14. Path 12 is an output path, which leads to a feeder 16 ejecting each finished sheet into an output tray 18. A sheet deflected along path 14 passes to the input nip 20 of a three-roll sheet-feeder generally referenced 22. Downstream of nip 20 is an inclined surface 24 leading to a substantially-vertical pocket 26. Although not shown in FIG. 1, the bottom of the pocket has in it known means, such as an aligned series of O-rings, positioned at a distance from the feeder 22 such that when the lead edge of the sheet being fed by nip 20 comes into contact with the O-rings etc., the trail edge of the sheet leaves the nip 20. Because of the lateral displacement (as viewed) of the pocket from the nip 20, the sheet being fed into the pocket necessarily has a curve induced in it. The natural resilience of the sheet material is used to flip the freed trail edge of the sheet to the right as viewed, immediately it is clear of the nip 20. The sheet itself has sufficient momentum to deflect the reversing means sufficiently to permit the trail edge of the sheet to move below the bottom of the centre roller 28. When the energy stored in the distorted reversing means is released, it is expended on reversing the direction of motion of the sheet, and force the former trail edge of the sheet to become a new lead edge, which is forced into the other nip 30 of feeder 22. The nip thus functions to extract the sheet from pocket 26, and pass it through a feeder 32 into a buffer tray 34, which is sometimes also known as a dedicated duplex tray. With the orientation as viewed, it will be seen that the face of the sheet having the first copy applied to it will be uppermost in tray 34. Each sheet in tray 34 is engaged by a bottom-mounted feeder 36 which is effective to extract the sheet from the tray 34 and turn it through a sufficient angle for its remaining blank side to come into contact with the photoreceptor 6, and for the process to be repeated. Matters are arranged that when the resultant duplex copy sheet leaves fuser 10, it is passed directly to output tray 18, without being redirected towards feeder 22.

In the sheet-feeder 40 of the present invention, as shown in FIG. 2, not only can simplex copies be inverted prior to their delivery to a buffer tray, but also duplex copies may be reinverted prior to delivery to an output tray, as well as simplex copies being inverted prior to delivery to a sorter which requires image-side-down copy orientation to ensure correct copy set collation. In the sheet-feeder shown in FIG. 1, it is often necessary to run all the original sheets through a counting, non-copying, cycle when the production of duplex copies has been chosen by the machine operator, in order to enable the machine to go through the alternative sequences when the number is odd or even. The necessity to go through this counting cycle (also known as 'slewing') wastes time and reduces the productivity of the machine and operator. In the sheet-feeder 40 of the present invention both duplex and simplex copy sheets from the processor are fed along path 42 to a common input nip 44. On leaving the nip, each sheet has its lead edge contacted by a diverter 46 pivoted to one or other of its limit positions. In the position shown in solid lines, the sheet is diverted into the right-hand pocket 48. Alternatively, when the diverter is in the position shown in broken lines, the respective sheet is diverted into the left-hand pocket 50. As already known, each pocket is provided with sheet-reversing means, so that after entering pocket 48, each sheet is bounced upwardly so that it enters the right-hand nip 52, from which the sheet passes to a buffer tray, in the manner similar to that described above in connection with FIG. 1. Likewise, each sheet fed into pocket 50 is bounced upwardly so that its new lead edge becomes engaged by the left-hand nip 54, which is effective to feed the sheet to an output tray.

It will be appreciated that the paths along which the sheets leave feeder 40 are dictated by the position in which the diverter 46 is at the time it is contacted by the lead edge of a sheet leaving nip 44. The operating position of diverter 46 is controlled automatically by software controlling a solenoid in response to the features selected by the operator, so that either simplex or duplex copies can be fed selectively into the two pockets. This thus increases the flexibility of the reprographic machine in its handling of both simplex and duplex copies by use of the sheet-feeder of this invention.

What is claimed is:

1. A sheet-feeding device, including four rollers providing three sheet-feeder nips; a solenoid-actuated diverter positioned downstream of the center nip, and two sheet pockets into each of which sheets can pass after having contacted said diverter, each pocket being aligned with one each of the two outer nips.

2. A sheet-feeder as claimed in claim 1, in which each pocket includes means for automatically reversing the direction of motion of each sheet after it has become fully positioned in its pocket, whereby the former trail edge becomes the new lead edge and enters the aligned nip, which proceeds to extract the sheet from its pocket.

3. The sheet-feeder of claim 2, in which said three sheet-feeder nips comprise four rollers which are of the same diameter, and have their axes lying in the same plane.

4. The sheet-feeder of claim 3, in which said diverter takes the form of a flap pivoted at a position remote from said center nip, and having its free end positioned close to the exit of said center nip, said sheet-feeder including a pocket separator having inclined surfaces downstream of said diverter to lead the lead edge of each sheet deflected by said diverter into the selected pocket.

5. The sheet-feeder of claim 4, wherein said two pockets are substantially parallel with each other, and have their center-lines spaced apart by a distance substantially equal to the combined diameter of two of the rollers.

* * * * *